United States Patent [19]

Hendrischk

[11] 4,400,101

[45] Aug. 23, 1983

[54] HIGH-QUALITY/HIGH-SPEED MATRIX PRINTING

[75] Inventor: Wolfgang Hendrischk, Neu-Ulm, Fed. Rep. of Germany

[73] Assignee: Mannesmann Aktiengesellschaft, Düsseldorf, Fed. Rep. of Germany

[21] Appl. No.: 250,117

[22] Filed: Apr. 2, 1981

[30] Foreign Application Priority Data

Jun. 10, 1980 [DE] Fed. Rep. of Germany ..... 3022128

[51] Int. Cl.[3] ..... B41J 3/12

[52] U.S. Cl. ..... 400/124; 101/93.05

[58] Field of Search ..... 400/121, 124; 101/93.04, 93.05

[56] References Cited

U.S. PATENT DOCUMENTS 4,010,835 3/1977 Martin et al. ..... 101/93.37 X 4,159,882 7/1979 Sanders et al. ..... 400/708 X

FOREIGN PATENT DOCUMENTS 2535699 3/1977 Fed. Rep. of Germany ..... 400/124

*Primary Examiner*—Paul T. Sewell

*Attorney, Agent, or Firm*—Ralf H. Siegemund

[57] ABSTRACT

The print head of a matrix printer includes two columns of print wires held in separate members which are individually vertically displaceable as well as together in order to obtain different conditions for printing. Good quality or high-speed modes can be obtained in a single pass, high quality in two passes, or a single pass with alternating, vertical displacement of the members for each print position.

7 Claims, 5 Drawing Figures

HIGH-QUALITY/HIGH-SPEED MATRIX PRINTING

BACKGROUND OF THE INVENTION

The present invention relates to matrix printing, i.e., to printing by means of composing a character from a multiple of dots; and more particularly, the invention relates to matrix print heads having a plurality of print wires or styli arranged in two or more vertical columns.

Matrix printers are widely in use today; their success is, no doubt, attributable to the fact that they constitute cost-effective, high-speed printers, the high speed being measured in relation to automatic typewriters, or the like. While satisfactory generally, the matrix printer is not usually regarded to be a high-quality printer, the term "quality" refering to the visual appearance of the printed characters. An improved appearance requires a larger number of print dots as well as a dot pattern in which dots are not juxtaposed but overlap. This feature, however, slows the printer down.

U.S. Pat. No. 3,757,346, for example, discloses a single column of wires or styli in the print head; and the wires are vertically displaceable through oblique, parallel guide slots for all of the needles. A particular and particularly controlled electromagnet serves as a drive for this displacement. A single column of styli is, however, detrimental and serves merely to reduce the number of styli. In the case of too few styli, the quality suffers.

German printed patent application No. 26 32 293 (based on U.S. patent application Ser. No. 600,985 of Aug. 1, 1978) suggests the use of a stationary column of styli next to a vertically displaceable one. The capability of vertical displacement serves for establishing a hybrid printer which combines: selective high speed or high quality. This known application describes also turning of the head about a horizontal axis. However, characters printed with a tilted head have inevitably a somewhat oblique appearance.

DESCRIPTION OF THE INVENTION

It is an object of the present invention to provide a new and improved manner of selective high-quality and high-speed printing.

It is another object of the present invention to provide a new and improved hybrid printer with different speed/quality combinations.

It is a specific object of the present invention to improve matrix dot printing by means of two (or more) columns of print wires.

In accordance with the preferred embodiment of the invention, it is suggested to have at least some of the wires each print two dots in a vertical spacing of less than the center-to-center spacing between adjacent print wires, and the respective other column has also one wire print, two dots, in the same horizontal print position, at a vertical spacing for the two dots of less than said center-to-center spacing so that a vertical bar of the length of this center-to-center spacing is printed by four overlapping dots. In the preferred form, a line is printed in a first pass, both columns participating in a dot-staggered relation step while both columns are shifted by a fraction of this center-to-center spacing, up or down, and the line is reprinted in an opposite pass. Alternatively, the two columns are shifted up or down in each horizontal print position in order to accomplish the same result in a single pass. It is important that both columns are vertically displaceable for accomplishing the fine composition of any line increment.

In the preferred form, the two guide members for the front ends of the print wires are mounted on cantilever leaf spring pairs. The members are moved up and down by means of drives such as solenoids, operating angle levers. The arrangement of the drives is preferably such that in some instances a uniform movement and displacement is obtained by operating drives in unison, while in other instances one drive is held to establish a fulcrum so that another drive can, in effect, shift one column relative to the other.

The inventive system, when using two columns, actually permits three grades of quality/speed combinations. The double-pass provides the highest quality at the slowest speed because two passes or equivalents are needed for each of the horizontal lines of printing. A median quality-median speed is accomplished by a single pass operation; high-speed operation is obtained by horizontally aligning the wires in pairs of the two columns and operating each column alternatingly.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

FIGS. 4 and 5 have been drawn to omit mutually obscuring portions.

Figure 4:
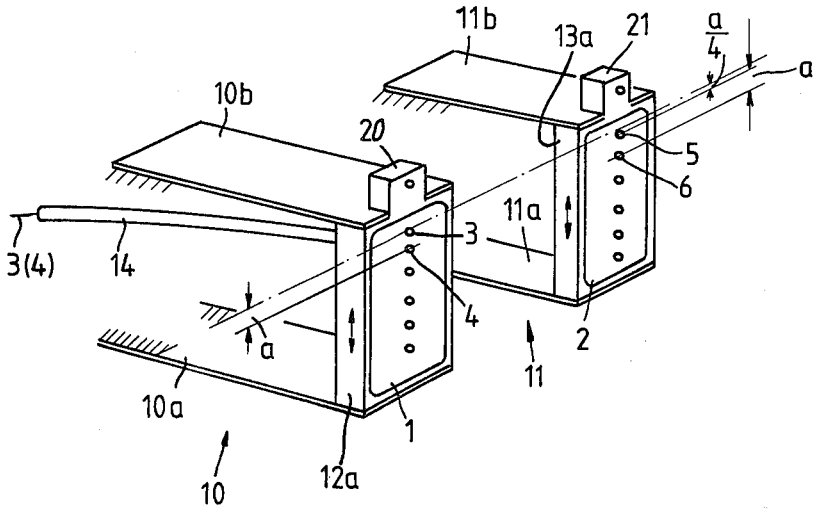
FIG. 4 is a perspective view of the displaceable suspension system for the two guide members.
Figure 5:
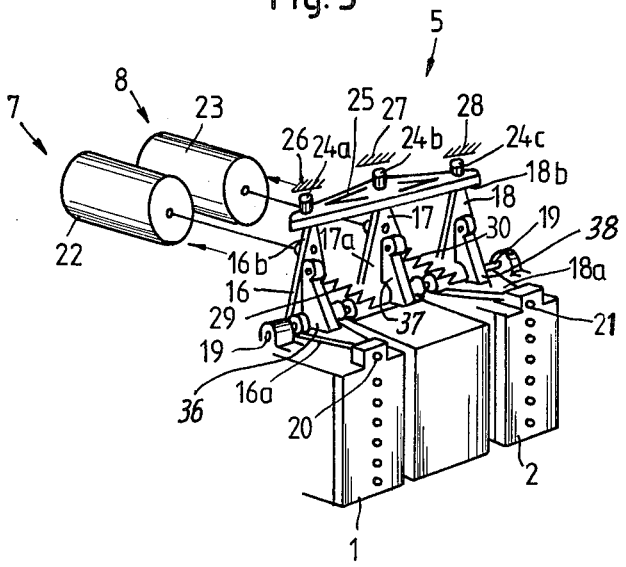
FIG. 5 is a similar perspective view of the drives for the members to obtain different vertical positions.

Proceeding now to the detailed description of the drawings, reference is made first to FIGS. 4 and 5. Two guide members 1 and 2 for print wires are provided for positioning the print end of these print wires, such as wires 3, 4, 5, 6, and so forth, in respectively two vertical columns. The two columns will print in a common plane and pertain to a print head which is moved horizontally parallel to that plane. One horizontal pass may print one line, but two passes may be needed for high-quality printing, as will be explained below.

These members are held in frames such as frames 12*a* and 13*a*, respectively pertaining to guide and positioning assemblies 10 and 11. Frame 12*a*, holding member 1, is mounted between the free ends of two vertically aligned leaf springs 10*a* and 10*b*; the other ends are secured in the print head structure. Analogously, frame 13*a* is held between the front ends of two leaf springs 11*a* and 11*b* of the positioning assembly 11. Thus, each guide member is held by a two-spring cantilever suspension.

The various print wires run in between these springs and FIG. 4 shows, by way of example, a guide tube 14 for one of the print wires (3). The other print wires are held analogously thereto. FIG. 4, as stated, just shows the guide member suspension for the print wires; FIG. 5 shows the vertical displacement mechanism 5, acting particularly on lugs or projections 20 and 21 of the frames 12*a* and 13*a*, as shown in FIG. 4.

The vertical displacement mechanism 5 includes particularly several angle levers (16, 17, and 18) journalled individually by means of shafts 19 to the print head frame, there being bearing elements affixed to and being part of that head frame. The levers 16 and 18 have respectively arms 16*a*, 16*b*, and 18*a*, 18*b*, whereby the front ends of the arms 16*a* and 18*a* are respectively inserted in lugs 20 and 21 of the frames 12*a* and 13*a*.

The arms 16*b* and 17*a* are acted upon directly by drives 7 and 8, respectively. These drives, respectively, include solenoids 22 and 23, tending to pull in (see arrows) their respective actuation arms upon being energized. There is no immediate drive provided to act directly upon arm 18*b*!

Figure 1:
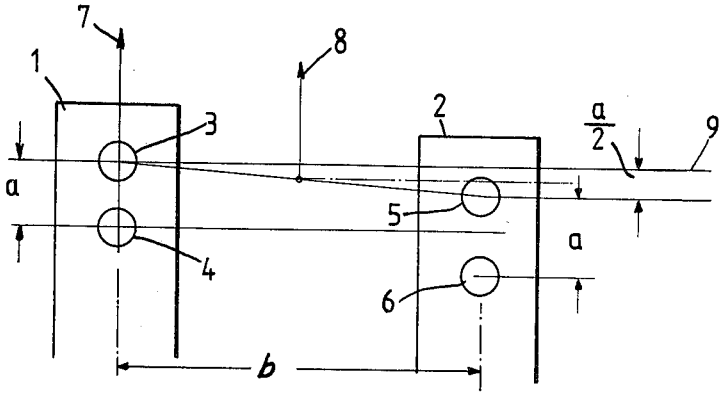
FIG. 1 is a front view of two print wire guide members for a high- or median-quality print operation involving a single pass of printing.

Arms 16*b* and 18*b*, but also arm 17*a* of the third lever, are provided respectively with pins 24*a*, 24*c*, and 24*b*, constituting the ends of these arms and being inserted in a traverse member 25. Stops 26, 27, and 28 limit individually the lateral displacement of these pins. Tension springs 29 and 30 bias the arms 16*b* and 17*a* into a particular, normal disposition of abutment against stop arms 36, 37, and 38. The resulting relative position of guide members 1 and 2, with no solenoid energized, is shown in FIG. 1.

Figure 2:
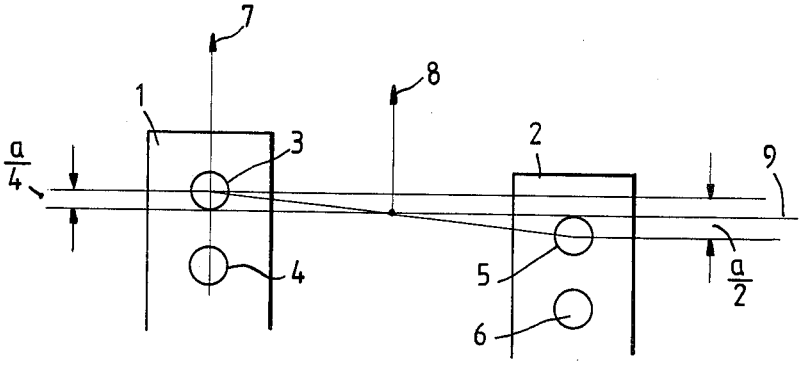
FIG. 2 illustrates the same two members following a common vertical readjustment to a second high-quality, supplementing pass.

The adjustmental operation for the two guide members 1 and 2, as suspended by assemblies 10 and 19, will now be explained with additional references to FIGS. 1, 2, and 3. It can readily be seen that the springs 29 and 30 tend to pivot arms 16*b* and 17*a* so that arms 16*b* and 17*a* abut in particular stops 36 and 37. As long as the solenoid 22 is de-energized, member 1 is necessarily at its lowest possible position. With solenoid 23 also de-energized, traverse 25 holds lever 18 so that member 2 is in its lowest position, which is slightly lower than the position of member 1. This position is detailed in FIG. 1. Herein, line 9 denotes a horizontal print reference line running through the center of the front end of the highest print wire (3) of and in the column in member 1. The highest wire (5) of the column in member 2 is held in a position so that its center is down by a spacing (a/2) from that reference line 9. This spacing is adjusted, to be exactly equal to half the vertical center-to-center spacing (a) between two wires, such as wires 3 and 4, or 5 and 6. FIG. 1 shows guide member 2 for each of its print wires 5 and 6 as well as others (not shown) to be vertically displaced (down) with respect to print wires 3, 4, and others in member 1 by a distance (a/2) in each instance. This resting position is adjusted, to be established by de-energized drives 7 and 8.

Upon properly controlling the timing and sequencing of print wire energization, it can readily be seen that wire 5 can be made to print exactly in between two dots as printed by wires 3 and 4. This is possible when the print head with the two members 1 and 2 has advanced horizontally by exactly the spacing "b" between the two print wire columns, assuming the head moves to the left. Alternatively (i.e., for an opposite direction of printing), wires 3 and 4 may print directly above and below a dot, previously printed by wire 5. In either case, this provides a good quality printout. In particular, each vertical line increment of length "a" will be composed of two dots. Each dot may be about (a/2) in diameter, possibly even a little larger.

A further improvement in the quality is obtained by printing the same line again in the opposite direction. For this, both of the two drives 7 and 8 are energized. Drive 7 will displace member 1 directly because that drive acts directly upon lever 16 so that member 1 is directly lifted. The lift stroke is adjusted to be (a/4). Exactly the same lift is provided by drive 8 upon lever 17; in other words, traverse 25 is displaced at two points by exactly the same spacing (a/4), which means that it is shifted in parallel by that spacing as to all of its points. Thus, by operation of traverse 25 (lever 18 is not spring-biased), lever arm 18*a* lifts also member 2 by exactly (a/4). The relative disposition of members 1 and 2 is retained (one being off by (a/2) relative to the other), but both are moved up by (a/4) relative to their previous disposition, which means that they are ±(a/4) off the previous print level 9. Now, the same line print program is run through again (but in inverse order), and dots are printed in between any two dots previously printed.

It can readily be seen that any line may be printed first with drives 7 and 8 energized, while the "reprinting" occurs with drives 7 and 8 de-energized. The end result is the same: each character is now composed of twice as many dots than produced in the first pass, and four times as many dots than obtainable with a single set of print wires in one guide member.

Figure 3:
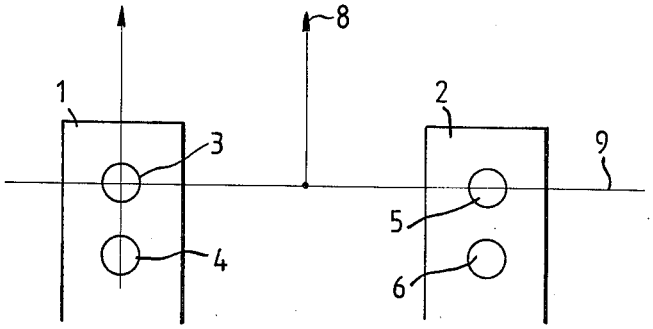
FIG. 3 illustrates the same two members adjusted for high-speed operation.

FIG. 3 illustrates the high-speed print mode. Only drive 8 is energized, providing a lift stroke by (a/4). However, drive 7 is not energized, and spring 29 retains arm 16 in the initial position. Thus, pin 24*a* acts as a fulcrum about which the traverse 25 pivots. Since drive 8 acts upon an in between point of traverse 25, the (a/4) equivalent displacement by drive 8 results in an (a/2) upward displacement of member 2. The two sets of print wires are now horizontally aligned (FIG. 3). The two columns of wires can be diffently controlled, printing different characters on different, horizontally spaced portions for characters so that, in fact, the print speed can be doubled. For example, one set of print wires prints, while the others (or some thereof) are in the return-stroke mode.

If each set of print wires is composed of seven wires, high-speed printing operates with a seven-dot column matrix; good quality (single-pass) printing operates with the equivalent of a fourteen-dot column, and high-quality (double-pass) printing operates with the equivalent of a twenty-eight-dot column. Particularly in the latter case, the dot composition of each character is practically completely eliminated.

It can readily be seen that the relationship between the two sets of columns of print wires and their guide members may be different for the same result. In the example above, adjacent print wires are spaced apart by a space a (center-to-center), which is about twice the diameter of each dot so that in each column, the unprinted space between two dots is approximately equal to the width (diameter) of either dot. The second set of print wires prints a dot in the middle of such a space. In the next pass, the center of additional print dots are placed in the area where two previously printed dot circles are (more or less) tangent to each other. This is the result of the (a/4) displacement of the two members 1 and 2. It can readily be seen that the sequence and arrangement can be a different one with the same result. In the initial, or first, pass, the two columns may be staggered by (a/4) only (rather than (a/2), as depicted). Thereafter, the two members are shifted upward (or downward) by (3a/4); and after this second pass, the same result is obtained in that each vertical bar of a length "a" is composed of four dots. The drive 8 would have to act on traverse 25 at a point ($\frac{3}{4}$) spaced from 24*a* in order to obtain an alignment position as per FIG. 3.

The principle expounded on above can be continued by using three columns for obtaining a still denser pattern of print dots. Another aspect has been alluded to earlier. The two members 1 and 2 may be moved up and down in each print position so that the complete high-quality print is obtained in a single pass which, of course, will last accordingly longer. The operation may be desirable if the data storage and flow rate for printing has to be handled differently because recalling the same line information twice may be impractical. Also, if there is an accidental, slight, relative, lateral shift, e.g., of the paper in between two passes, the quality of the characters may not be improved, but may deteriorate by the two-passes-per-line approach. Another aspect is the following: the two drives have been shown and described with reference to equal strokes of and by the respective solenoids 22 and 23. This is not essential in principle because, for different purposes, different relative dispositions of the two members 1 and 2 may be required. However, equal strokes are required for all instances of a common displacement of the two members 1 and 2 by the same amount.

Another aspect is the following: The drive 8 could be used to operate lever 18 directly and, through it, the member 2. This, however, would require the drive to be able to provide two different strokes: an (a/4) and an (a/2) stroke. This could be accomplished, e.g., through appropriate and appropriately controlled stops. However, the illustrated arrangement is clearly preferred.

The invention is not limited to the embodiments described above; but all changes and modifications thereof, not constituting departures from the spirt and scope of the invention, are intended to be included.

I claim:

1. In a matrix print head having at least two sets of print wires, the wires having front ends held in guide members and in vertical alignment for each set of wires, there being two guide members accordingly, the guide members being spaced apart in the direction of printing, the improvement comprising, in combination:

means for individually mounting the guide members to permit vertical displacement of each of them without lateral displacement in the direction of printing along the line and without rotation, adjacent wires in each member being spaced by a particular distance; and control means for displacing each one of the guide members vertically, equivalent to a displacement by less than said particular distance for each possible print position, the front ends of the wires in the two guide members being staggered before and after such displacement so that a vertical line increment of a length of said particular distance can be printed by three or more fully printed dots in two passes respectively before and after such displacement, and for relatively displacing the guide members relative to each other to obtain a horizontal alignment of the front ends of the wires so that a vertical line increment of a length of said particular distance can be printed by one dot from a wire of one of the members only for obtaining a doubling of the print speed.

2. In a print head as in claim 1, each one of said guide members being mounted in cantilever spring means, extending in the same general direction as the print wires and permitting said vertical displacements of the guide members without said lateral displacement and said rotation.

3. In a print head as in claim 2, the spring means for each of the members including a pair of leaf springs, the respective member being mounted to free ends of the leaf spring.

4. In a print head as in claim 3, the members each being mounted in a frame, there being an angle lever having one end linked to the frame, the control means including drive means acting horizontally upon another end of the angle lever for pivoting the lever, thereby moving the member up or down.

5. In a matrix print head having at least two sets of print wires, the wires having front ends held in guide members and in vertical alignment for each set of wires, there being two guide members accordingly, the guide members being spaced apart in the direction of printing, the improvement, in combination, comprising:

means for individually mounting the guide members to permit vertical displacement of each of them without lateral displacement in the direction of printing along the line and without rotation, adjacent wires in each member being spaced by a particular distance; and drive means including pivotably mounted angle levers for vertically displacing the members in unison and, as to at least one member, for individually displacing the one member vertically without the other one to obtain different vertical dispositions of both members together, relative to a print line and selectively, individually relative to each other.

6. The combination as in claim 5, the drive means including:

three angle levers, a first and a second one thereof being drivingly linked to said members;

a traverse linking said three angle levers; and two electromagnetic means respectively driving the first and a third one of the levers, the latter levers being spring-biased into particular positions of unenergized electromagnetic means.

7. In a matrix print head having at least two sets of print wires, the wires having front ends held in guide members and in vertical alignment for each set of wires, there being two guide members accordingly, the guide members being spaced apart in the direction or printing, the improvement, in combination, comprising:

means for individually mounting the guide members to permit vertical displacement of each of them without lateral displacement in the direction of printing along the line and without rotation, adjacent wires in each member being spaced by a particular distance;

first control means for adjustably holding the guide members in a horizontally staggered disposition, corresponding to a relative displacement of the members relative to each other by a spacing of a particular fraction of said particular distance; and second control means for shifting said members in unison in the vertical direction by a spacing, also being a fraction of said distance so that printing of any character be obtained twice, first in horizontal print positions in which the first control means hold the members, and, additionally, in the same print positions following a vertical shift by the second control means.

* * * * *